US011350782B2

(12) United States Patent
Beam, Sr.

(10) Patent No.: US 11,350,782 B2
(45) Date of Patent: Jun. 7, 2022

(54) REMOTE-CONTROLLED MAILBOX

(71) Applicant: Doug Beam, Sr., Moores Hill, IN (US)

(72) Inventor: Doug Beam, Sr., Moores Hill, IN (US)

( * ) Notice: Subject to any disclaimer, the term of this patent is extended or adjusted under 35 U.S.C. 154(b) by 0 days.

(21) Appl. No.: 17/182,360

(22) Filed: Feb. 23, 2021

(65) Prior Publication Data

US 2021/0267399 A1 Sep. 2, 2021

Related U.S. Application Data

(60) Provisional application No. 62/982,132, filed on Feb. 27, 2020.

(51) Int. Cl.
*A47G 29/12* (2006.01)

(52) U.S. Cl.
CPC ..... *A47G 29/1216* (2013.01); *A47G 29/1209* (2013.01); *A47G 29/1214* (2013.01)

(58) Field of Classification Search
CPC ..... A47G 29/1209; A47G 29/1214; A47G 29/1216; F16M 11/42; F16M 11/425; A63H 19/15; A63H 19/30; B07C 3/082
USPC ..... 232/17, 39; 248/128, 129; 104/177, 305
See application file for complete search history.

(56) References Cited

U.S. PATENT DOCUMENTS 1,113,451 A * 10/1914 Levasseur et al. ..... E01B 25/18 104/115
1,205,065 A * 11/1916 Weathers ..... B61B 10/04 104/172.3
1,260,877 A * 3/1918 Cunningham ..... B61B 3/00 104/89
1,286,144 A * 11/1918 Tauber ..... E01B 25/18 104/115
2,108,453 A * 2/1938 Spencer ..... B61B 9/00 104/177
2,179,913 A * 11/1939 Bess ..... A47G 29/1216 104/303
3,066,616 A * 12/1962 Weisberg ..... A47G 29/1216 104/172.3
4,868,543 A 9/1989 Binkley
5,088,644 A * 2/1992 Scott ..... A47G 29/1216 104/177
5,353,887 A * 10/1994 Putnam ..... A61G 5/043 104/246
5,632,441 A * 5/1997 Toval ..... A47G 29/1216 232/17
7,051,920 B1 * 5/2006 Asch ..... A47G 29/1216 104/177
7,222,779 B1 5/2007 Pineda-Sanchez et al.
(Continued)

*Primary Examiner* — William L Miller
(74) *Attorney, Agent, or Firm* — Boudwin Intellectual Property; Daniel Boudwin

(57) ABSTRACT

A remote-controlled mailbox is provided. The device includes a mailbox housing having an open front end and a front door pivotally affixed thereto, wherein the front door selectively closes the front end. A post is affixed to a base of the mailbox housing. A frame is affixed to a lower end of the post, wherein the frame movably engages a track. Upon actuation of a motor of a mechanical drive system, the frame moves along the track, thereby moving the post and mailbox housing in kind. A remote device includes a plurality of controls thereon, wherein the plurality of controls is operably connected to the motor. Upon actuation of the plurality of controls, the mechanical drive system selectively moves the frame along the track.

15 Claims, 3 Drawing Sheets

(56) References Cited

U.S. PATENT DOCUMENTS

| | | | | |
|---|---|---|---|---|
| 8,123,113 | B1 * | 2/2012 | Hartman | A47G 29/1216 232/39 |
| 9,357,867 | B2 | 6/2016 | Bryan | |
| 2015/0359372 | A1 | 12/2015 | Cho et al. | |
| 2018/0067481 | A1 * | 3/2018 | Wallace | A47G 29/1225 |

* cited by examiner

REMOTE-CONTROLLED MAILBOX

CROSS REFERENCE TO RELATED APPLICATIONS

This application claims the benefit of U.S. Provisional Application No. 62/982,132 filed on Feb. 27, 2020. The above identified patent application is herein incorporated by reference in its entirety to provide continuity of disclosure.

BACKGROUND OF THE INVENTION

The present invention relates to mailboxes. More particularly, the present invention pertains to a remote-controlled mailbox that can be moved closer to a user's home to minimize the risk and effort required to retrieve delivered mail.

Many individuals have free-standing mailboxes placed at the end of a driveway or other location adjacent to a street for easy access for mail delivery purposes. This requires the user to walk to the end of the driveway and frequently step into the street to access a front mailbox door. When the mailbox is positioned this close to the street, the user can be placed in immediate danger as vehicles may be prone to traveling at high speeds, which can potentially lead to an accident. Furthermore, during periods of inclement weather, such as when snow or ice accumulates, walking to the mailbox can potentially risk injury should the user slip or fall. At the least, making repeated trips to the mailbox can be inconvenient or time-consuming. Therefore, a mailbox system that can move the mailbox nearer to the user's home to reduce the distance the user must travel to retrieve the mail while reducing the potential danger presented by retrieving the mail is desired.

In light of the devices disclosed in the known art, it is submitted that the present invention substantially diverges in design elements from the known art and consequently it is clear that there is a need in the art for an improvement to existing mailboxes. In this regard, the instant invention substantially fulfills these needs.

SUMMARY OF THE INVENTION

In view of the foregoing disadvantages inherent in the known types of mailboxes now present in the known art, the present invention provides a remote-controlled mailbox wherein the same can be utilized for providing convenience for the user when minimizing risk and effort required to retrieve delivered mail.

The present system comprises a mailbox housing having an open front end and a front door pivotally affixed thereto, wherein the front door selectively closes the front end. In some embodiments, the mailbox housing further comprises an open rear end having a rear door pivotally affixed thereto, wherein the rear door selectively closes the rear end. A post is affixed to a base of the mailbox housing. A frame is affixed to a lower end of the post, wherein the frame movably engages a track. Upon actuation of a motor of a mechanical drive system, the frame is configured to move along the track, thereby moving the post and mailbox housing in kind. A remote device includes a plurality of controls thereon, wherein the plurality of controls is operably connected to the motor. Upon actuation of the plurality of controls, the mechanical drive system selectively moves the frame along the track.

In some embodiments, the track comprises a first leg and a second leg disposed perpendicularly relative to each other.

In another embodiment, the track comprises an arcuate bend between the first leg and the second leg. In other embodiments, the post is rotationally affixed to the frame, such that when the frame travels between a first end of the track and a second end of the track, the post rotates to position the front end of the mailbox housing parallel and adjacent to the second end. In yet another embodiment, the mechanical drive system comprises a plurality of wheels disposed within the frame, wherein the plurality of wheels configured to drive the frame along the track when the motor is actuated. In some embodiments, the track is disposed within a channel extending through a ground surface between a curb and a driveway. In another embodiment, the channel is enclosed by a flexible material allowing the post to extend therethrough, wherein the flexible material is configured to form a watertight seal over the channel. In other embodiments, the flexible material comprises a color configured to blend into the ground surface.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
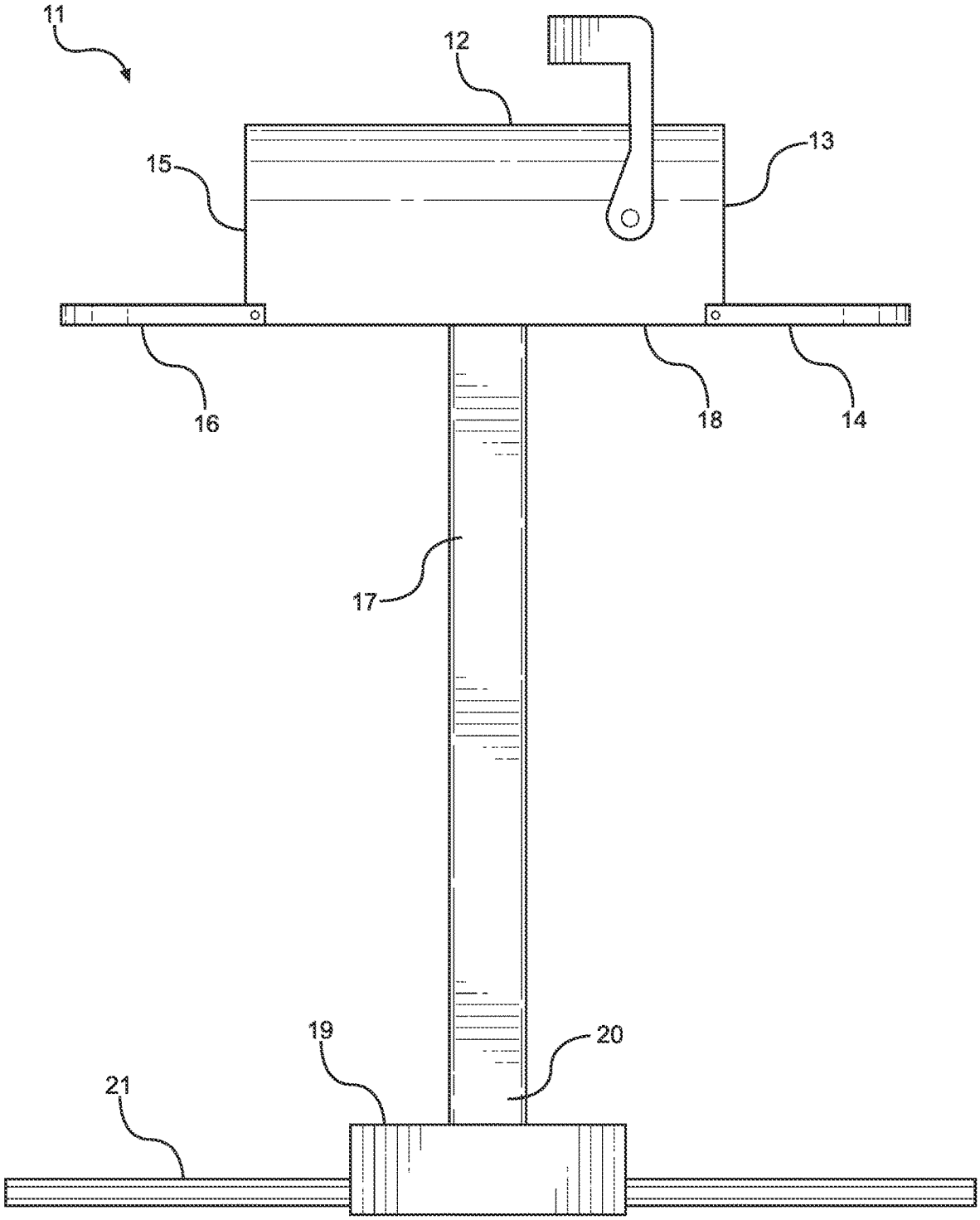
FIG. 1 shows a perspective view of an embodiment of the remote-controlled mailbox.

Reference is made herein to the attached drawings. Like reference numerals are used throughout the drawings to depict like or similar elements of the remote-controlled mailbox. The figures are intended for representative purposes only and should not be considered to be limiting in any respect.

Referring now to FIG. 1, there is shown a perspective view of an embodiment of the remote-controlled mailbox. The remote-controlled mailbox system 11 comprises a mailbox housing 12 having an open front end 13 providing access to an interior volume. A front door 14 is hingedly affixed to the mailbox housing 12 at the open front end 13, wherein the front door 14 is configured to selectively close the open front end 12 when moved to a closed position. In the shown embodiment, the front door 14 is affixed to the mailbox housing 12 along a base 18 of the mailbox housing 12, however, in alternate embodiments, the front door 14 may be hingedly affixed to the mailbox housing 12 along an alternate sidewall. In the illustrated embodiment, the mailbox housing 12 further comprises an open rear end 15 such that the interior volume can be accessed from opposing ends of the mailbox housing 12. Similarly, a rear door 16 may be hingedly affixed to the open rear end 15 of the mailbox housing 12, wherein the rear door 16 is configured to selectively close the rear end 15 when the rear door 16 is moved to the closed position. In the shown embodiment, the mailbox housing 12 includes an arcuate upper wall opposite the base 18, however, in alternate embodiments the mailbox housing 12 comprises a variety of other shapes. A post 17 is affixed to the base 18 and serves to elevate the mailbox housing 12 to a desired height to provide convenient access to the interior volume.

Figure 3:
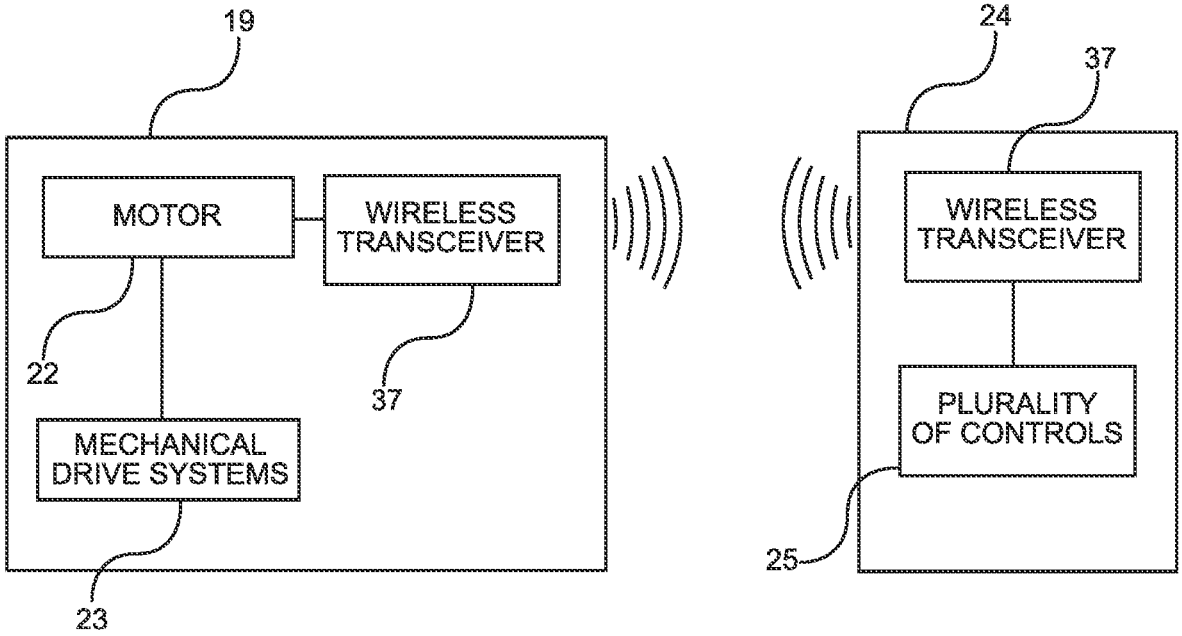
FIG. 3 shows a schematic view of an embodiment of the remote-controlled mailbox.
Figure 4:
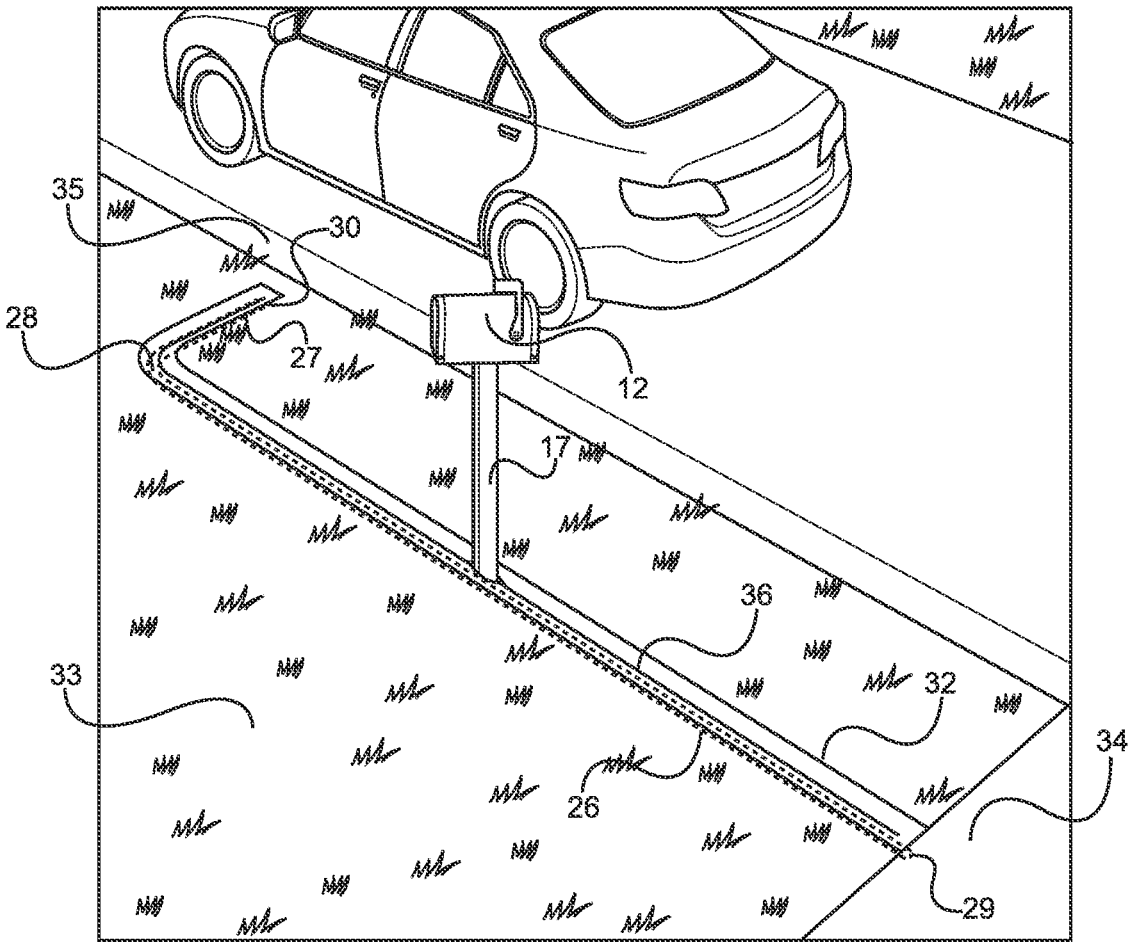
FIG. 4 shows a perspective view of an embodiment of the remote-controlled mailbox in use.

The post 17 is affixed to a frame 19 at a lower end 20 of the post 17, wherein the frame 19 is movably engaged with a track 21. In this manner, the frame 19 can transport the mailbox housing 12 and post 17 along the track 21 when a motor (as shown FIG. 3, 22) disposed within the frame 19 is actuated via a mechanical drive system (as shown in FIG. 3, 23). The track 21 can be installed upon or within a ground surface (as shown in FIG. 4, 33) to guide the frame 19 between a pair of desired end points to minimize travel required to retrieve mail from the mailbox housing 12. For example, a first end of the track 21 may be placed along a curb or street side where a mailbox housing 12 is typically installed, and the opposing end of the track 21 may be placed adjacent to a driveway or building entrance. In this manner, the mailbox housing 12 can be placed adjacent to a street for mail delivery, while allowing the user to summon the mailbox housing 12 to a nearer location to minimize the distance to travel or the risk of injury associated with retrieving mail from the mailbox housing 12.

Figure 2:
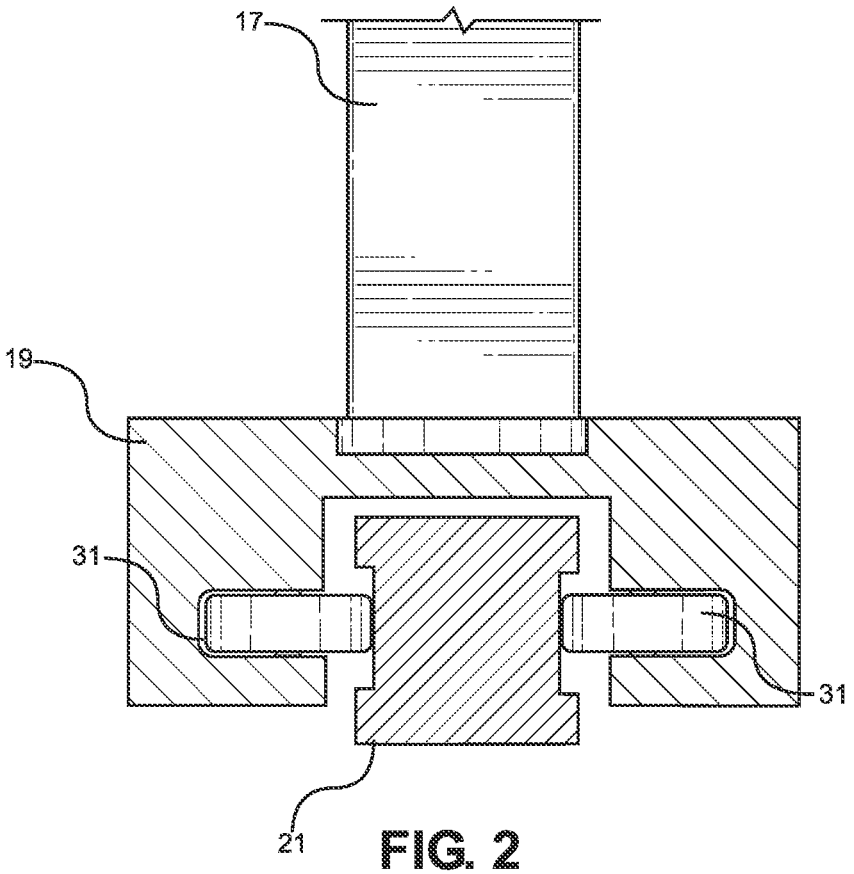
FIG. 2 shows a cross-sectional view of the frame and track system of an embodiment of the remote-controlled mailbox.

Referring now to FIG. 2, there is shown a cross-sectional view of the frame and track system of an embodiment of the remote-controlled mailbox. In the illustrated embodiment, the frame 19 comprises a U-shaped structure wherein a pair of legs of the frame 19 straddle the track 21. In some such embodiments, the mechanical drive system comprises a plurality of wheels 31 perpendicularly aligned with the pair of legs, such that the plurality of wheels 31 contact and engage opposing sides of the track 21. In this manner, the plurality of wheels 31 are substantially parallel to the ground surface. When the motor is actuated, the plurality of wheels 31 are rotated in a desired direction to drive the frame 19 along the track 21. In the illustrated embodiment, the track 21 comprises an I-beam structure having a central channel configured to engage the plurality of wheels 31. In some embodiments, an upper end of the track 21 comprises a width greater than that of a lower end of the track 21 as well as a linear distance between the plurality of wheels 31. In this manner, the plurality of wheels 31 are retained on the track 21 during operation to prevent the frame 19 from becoming unseated from the track 21. In the illustrated embodiment, the post 17 is rotationally affixed to the frame 19 via a rotational plate or other rotation mechanism, such that as the frame 19 travels along the track 21, the post 17 rotates to shift the orientation of the mailbox housing 12. In some such embodiments, the rotational mechanism may be directly tied to the mechanical drive system, such that the orientation of the mailbox housing is directly related to the position of the frame 19 along the track 21. In alternate embodiments, the post 17 rotates independently relative to the position of the frame 19 along the track 21.

Referring now to FIG. 3, there is shown a schematic view of an embodiment of the remote-controlled mailbox. In the illustrated embodiment, the frame 19 is in communication with a remote device 24 via wireless transceivers 37 disposed within each of the frame 19 and the remote device 24. The remote device 24 includes a plurality of controls 25 thereon, wherein the plurality of controls 25 are configured to selectively move the frame 19 in a desired direction along the frame. For example, a first control of the plurality of controls 25 drives the frame 19 along the track in a first direction, while a second control of the plurality of controls 25 drives the frame 19 along the track in a second direction. In other embodiments, the plurality of controls 25 further dudes controls to adjust the rotational position of the post. In the shown embodiment, the motor 22 is operably connected to the mechanical drive system 23, such that upon receipt of a control signal from the remote device 24, the motor 22 activates the mechanical drive system 23 to drive the frame 19. As previously described, the mechanical drive system 23 can comprise a plurality of wheels, however, in alternate embodiments, the mechanical drive system 23 can comprise chain and belt driven mechanical drive systems 23. In this manner, the frame 19 can be modified to operate with a variety of mechanical drive systems 23 as desired by the user for personal preference, maintenance requirements, and the like.

Referring now to FIG. 4, there is shown a perspective view of an embodiment of the remote-controlled mailbox in use. In the shown embodiment, the track comprises a first leg 26 disposed perpendicular to a second leg 27, wherein the first and second legs 26, 27 are connected about an arcuate bend 28. The arcuate bend 28 is configured to allow the frame to easily traverse the 90-degree angle between the first and second legs 26, 27. In the illustrated embodiment, a first end 29 of the track is disposed adjacent to a curb 34 and a second end 30 is disposed adjacent to a driveway 35. In such embodiments, the mailbox housing 12 is configured to travel between the curb 34 and the driveway 35 to allow a user to retrieve mail from the mailbox housing upon arriving home by summoning the mailbox housing 12 to the driveway 35. In alternate embodiments, the second end 30 of the track may be placed adjacent to a building entrance or the like to allow a user to retrieve mail from the mailbox housing 12 without leaving the building. The mailbox housing 12 can be configured to rotate via the post 17 as the frame travels along the track, such that the front end of the mailbox housing 12 is disposed parallel and adjacent to the first end 29 of the track when the frame is in a curbside position and the front end is disposed parallel and adjacent to the second end 30 when the frame is in a retrieval position. In some embodiments having an open rear end, as shown in FIG. 1, the post 17 may be statically affixed to the frame. In this manner, the user can readily retrieve mail from the mailbox housing 12 while at the second end 30 of the track.

In the illustrated embodiment, the track is disposed within a channel 32 within the ground surface 33 such that the track is not visibly resting on the ground surface 33. In some such embodiments, a flexible material 36 is disposed over the channel 32 in a pair of separate strips along a longitudinal axis of the channel 32. In this manner, a slit is formed between the separate strips of flexible material 36 to allow the post 17 to extend therethrough. In some embodiments, the flexible material 36 is configured to form a watertight seal over the channel 32 such that rain, snow, or the like is prevented from contacting the track and frame system. Similarly, in some embodiments, the channel 32 may be lined in a water impermeable material to prevent ground water from seeping into the channel 32. As the post 17 traverses the length of the track, the strips of flexible material 36 flex about the post 17 maintaining the watertight seal to allow operation during inclement weather. In some embodiments, the flexible material 36 comprises a color configured to match a color of the ground surface 33, such that the presence of the channel 32 is camouflaged.

In one use, the mailbox housing 12 is positioned at the first end 29 adjacent to the curb 34 for receiving mail delivery. Once the mail has been delivered and placed within the mailbox housing 12 via the front door, the user can operate one of the plurality of controls on the remote device to activate the mechanical drive system, allowing the frame to travel along the track. Once the mailbox housing 12 is adjacent to the second end 30, the user can then retrieve mail from the mailbox housing 12. In embodiments where the post 17 is rotatably affixed to the frame, the mailbox housing 12 is configured to rotate at least 90-degrees to position the open front end adjacent to the second end 30. In the illustrated embodiment, the user can retrieve the mail from the mailbox housing 12 from a vehicle within the driveway 35. In alternate embodiments, the second end 30 of the track may be placed adjacent to the building entrance, such that the user need not leave the building to retrieve the mail. In this manner, the user can safely and efficiently retrieve the mail without risking injury due to traffic adjacent to the mailbox and minimizing the overall distance that must be traveled.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A remote-controlled mailbox, comprising:

a mailbox housing having an open front end and a front door pivotally affixed thereto, wherein the front door selectively closes the front end;

a post affixed to a base of the mailbox housing;

a frame affixed to a lower end of the post, wherein the frame movably engages a track;

whereupon actuation of a motor of a mechanical drive system, the frame is configured to move along the track, thereby moving the post and mailbox housing in kind;

wherein the post is rotationally affixed to the frame, such that when the frame travels between a first end of the track and a second end of the track, the post rotates to position the front end of the mailbox housing parallel and adjacent to the second end;

a remote device having a plurality of controls thereon, wherein the plurality of controls is operably connected to the motor;

whereupon actuation of the plurality of controls, the mechanical drive system selectively moves the frame along the track.

2. The remote-controlled mailbox of claim 1, wherein the track comprises a first leg and a second leg disposed perpendicularly relative to each other.

3. The remote-controlled mailbox of claim 2, wherein the track comprises an arcuate bend between the first leg and the second leg.

4. The remote-controlled mailbox of claim 1, wherein the mechanical drive system comprises a plurality of wheels are disposed within the frame, wherein the plurality of wheels configured to drive the frame along the track when the motor is actuated.

5. The remote-controlled mailbox of claim 1, wherein the track is disposed within a channel extending through a ground surface between a curb and a driveway.

6. The remote-controlled mailbox of claim 5, wherein the channel is enclosed by a flexible material allowing the post to extend therethrough, wherein the flexible material is configured to form a watertight seal over the channel.

7. The remote-controlled mailbox of claim 6, wherein the flexible material comprises a color configured to blend into the ground surface.

8. A remote-controlled mailbox, comprising:

a mailbox housing having an open front end and an open rear end;

a front door pivotally affixed to the open front end, wherein the front door selectively closes the front end;

a rear door pivotally affixed to the open rear end, wherein the rear door selectively closes the rear end;

a post affixed to a base of the mailbox housing;

a frame affixed to a lower end of the post, wherein the frame movably engages a track;

whereupon actuation of a motor of a mechanical drive system, the frame is configured to move along the track, thereby moving the post and mailbox housing in kind;

wherein the post is rotationally affixed to the frame, such that when the frame travels between a first end of the track and a second end of the track, the post rotates to position the front end of the mailbox housing parallel and adjacent to the second end;

a remote device having a plurality of controls thereon, wherein the plurality of controls is operably connected to the motor;

whereupon actuation of the plurality of controls, the mechanical drive system selectively moves the frame along the track.

9. The remote-controlled mailbox of claim 8, wherein the track comprises a first leg and a second leg disposed perpendicularly relative to each other.

10. The remote-controlled mailbox of claim 9, wherein the track comprises an arcuate bend between the first leg and the second leg.

11. The remote-controlled mailbox of claim 8, wherein the mechanical drive system comprises a plurality of wheels are disposed within the frame, wherein the plurality of wheels configured to drive the frame along the track when the motor is actuated.

12. The remote-controlled mailbox of claim 8, wherein the track is disposed within a channel extending through a ground surface between a curb and a driveway.

13. The remote-controlled mailbox of claim 12, wherein the channel is enclosed by a flexible material allowing the post to extend therethrough, wherein the flexible material is configured to form a watertight seal over the channel.

14. The remote-controlled mailbox of claim 13, wherein the flexible material comprises a color configured to blend into the ground surface.

15. A remote-controlled mailbox, comprising:

a mailbox housing having an open front end and a front door pivotally affixed thereto, wherein the front door selectively closes the front end;

a post affixed to a base of the mailbox housing;

a frame affixed to a lower end of the post, wherein the frame movably engages a track;

wherein the track comprises a first leg and a second leg disposed perpendicularly relative to each other;

wherein the track comprises an arcuate bend between the first leg and the second leg;

whereupon actuation of a motor of a mechanical drive system, the frame is configured to move along the track, thereby moving the post and mailbox housing in kind;

a remote device having a plurality of controls thereon, wherein the plurality of controls is operably connected to the motor;

whereupon actuation of the plurality of controls, the mechanical drive system selectively moves the frame along the track.

* * * * *